United States Patent [19]

Hiraoka et al.

[11] Patent Number: 4,526,617

[45] Date of Patent: Jul. 2, 1985

[54] WEAR RESISTANT FERRO-BASED SINTERED ALLOY

[75] Inventors: Takeshi Hiraoka; Shigeru Urano; Masajiro Takeshita, all of Saitama; Keiji Nakamura, Chiba, all of Japan

[73] Assignee: Nippon Piston Ring Co., Ltd., Tokyo, Japan

[21] Appl. No.: 148,357

[22] Filed: May 9, 1980

[30] Foreign Application Priority Data

May 9, 1979 [JP] Japan ..... 54-55683

[51] Int. Cl.[3] ..... B22F 3/00

[52] U.S. Cl. ..... 75/236; 75/246

[58] Field of Search ..... 75/203, 204, 123 D, 75/125, 123 J, 123 K, 126 F, 126 R, 236, 239, 243, 246; 428/550

[56] References Cited

U.S. PATENT DOCUMENTS

| | | | |
|---|---|---|---|
| 4,035,159 | 7/1977 | Hashimoto et al. | 75/246 |
| 4,080,205 | 3/1978 | Niimi et al. | 75/241 |
| 4,243,414 | 1/1981 | Takahashi | 75/244 |
| 4,274,876 | 6/1981 | Kodama et al. | 75/243 |
| 4,348,232 | 9/1982 | Hiraoka et al. | 75/238 |
| 4,363,662 | 12/1982 | Takahashi et al. | 75/243 |

FOREIGN PATENT DOCUMENTS

| | | | |
|---|---|---|---|
| 48010 | 5/1978 | Japan | 75/246 |

*Primary Examiner*—L. Dewayne Rutledge
*Assistant Examiner*—John J. Zimmerman
*Attorney, Agent, or Firm*—Sughrue Mion Zinn Macpeak

[57] ABSTRACT

A wear resistant ferro-based sintered alloy comprising a base structure comprising a mixture of 20 to 50% by area ratio of pearlite, 15 to 40% by area ratio of bainite and 15 to 40% by area ratio of martensite, and 3 to 20% by area ratio of ferromolybdenum particles dispersed uniformly in the base structure is disclosed.

1 Claim, 2 Drawing Figures

WEAR RESISTANT FERRO-BASED SINTERED ALLOY

BACKGROUND OF THE INVENTION

1. Field of the Invention

The present invention relates to wear resistant ferro-based sintered alloy for use as wear resistant members of internal combustion engines, more particularly, those members which require thermal resistance, corrosion resistance and wear resistance simultaneously such as valve seats, valves, etc., and other slidable members.

2. Description of the Prior Art

Conventionally, wear resistant ferro-based sintered alloys comprising various carbides having a high hardness have been used. These alloys are used widely as valve seats and are useful for the purpose to some extent. That is, these alloys have been developed in order to cope with a problem of adhesion wear which has become more and more serious as a result of the use of leadless gasoline, and the fact that lubrication between valves by lead is no longer available.

Although efforts have been made heretofore for improving this drawbacks, as far as is known no sintered alloy has been developed which can sufficiently meet the requirements for slidable members for internal combustion engines to be operated under severe conditions employed recently.

It is strongly desired that alloys free of the defects of the conventional alloys, especially those in which wear resistance, in particular, adhesion wear is improved be developed.

SUMMARY OF THE INVENTION

A primary object of the present invention is to eliminate the drawbacks involved in the prior arts and provide a wear resistant ferro-based sintered alloy having excellent wear resistance under severe operating conditions.

As a result of extensive research, it is found that the presence of ferromolybdenum particles in the base structure or matrix and specific proportion of pearlite, bainite and martensite therein are important for wear resistance. The present invention is based on this finding and provides a wear resistant ferro-based sintered alloy which comprises a base structure comprising a mixture of 20 to 50% by area ratio of pearlite, 15 to 40% by area ratio of bainite and 15 to 40% by area ratio of martensite, and 3 to 20% by area ratio of ferromolybdenum particles dispersed uniformly in the base structure.

DETAILED DESCRIPTION OF THE INVENTION

Figure 1:
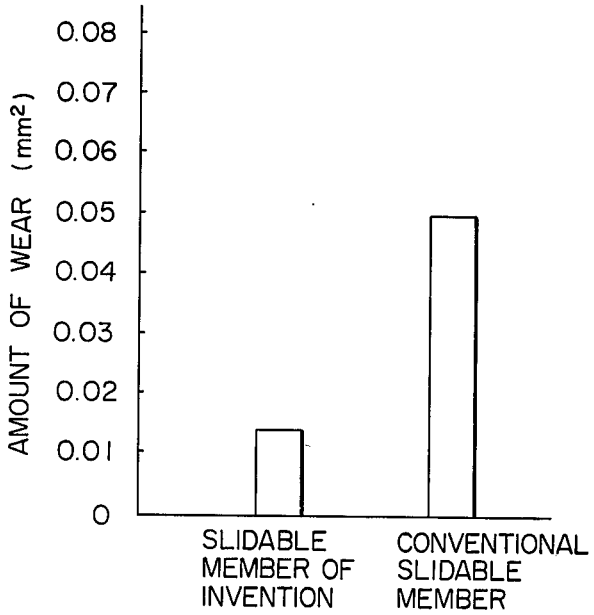
FIG. 1 is a graph showing the results of comparison of wear resistance between the valve seat made of the wear resistant sintered alloy of the present invention and that made of the conventional sintered alloy.

The reason for limiting the abundance of various structures in the base structure are as follows.

Pearlite is necessary for providing the alloy with toughness. When the amount of pearlite is less than 20% by area ratio satisfactory toughness of the base structure cannot be obtained, while with more than 50% by area ratio of pearlite wear resistance is insufficient since pearlite in itself is relatively soft. Therefore, the amount of pearlite is limited to 20 to 50% by area ratio.

Regarding bainite and martensite, these structures are necessary for improving wear resistance. Each structure should be present in an amount of 15 to 40% by area ratio since with less than 15% by area ratio no satisfactory wear resistance can be obtained, while with more than 40% by area ratio hardness of the base structure is elevated more than is necessary resulting in that not only the base structure becomes brittle but also the member will wear a counterpart member which is in a slidable contact therewith. Furthermore, machineability of the alloy is degraded with such high amount.

Ferromolybdenum particles insure excellent wear resistance under severe conditions such as at high temperatures and under high loads. With less than 3% by area ratio of ferromolybdenum particles no satisfactory wear resistance can be obtained. On the other hand, with more than 20% by area ratio the alloy material becomes brittle to such an extent it can be employed no longer. Therefore, the content of ferromolybdenum is limited to 3 to 20% by area ratio.

As stated above, the sintered alloy of the present invention exhibits excellent wear resistance due to the dispersion of ferromolybdenum particles in the base structure having a specific mixed construction comprising pearlite, bainite and martensite. In other words, excellent wear resistance when in use under severe conditions of the sintered alloy of the present invention is ascribable to synergistic effect attained by the mixed base structure exhibiting toughness and wear resistance and the ferromolybdenum particles having a high hardness and wear resistance.

The wear resistant ferro-based sintered alloy of the present invention having the characteristics described above should comprise 0.8 to 1.5% by weight of carbon, 1.5 to 4.0% by weight of nickel, 0.5 to 2.0% by weight of copper, 2.5 to 6.5% by weight of molybdenum and the balance iron.

The reason for limiting the various individual components of the sintered alloy of the present invention is explained as follows.

Carbon is used in an amount of 0.8 to 1.5% by weight. With less than 0.8% by weight ferrite, which is undesirable in view of wear resistance, precipitates. On the other hand, with more than 1.5% by weight free graphite precipitates in the pearlite structure and the amount of cementite is more than necessary and therefore no tough base structure can be obtained.

Nickel is added in an amount of 1.5 to 4.0% by weight. When the nickel component is less than 1.5% by weight the amounts of bainite and martensite are so small that the base structure cannot exhibit desired properties. On the other hand, when the nickel content is more than 4.0% by weight, the hardness of the base structure is elevated excessively so that the base structure becomes brittle and further the member will wear a counterpart member with which it is in slidable contact. Moreover, machineability of the alloy is degraded.

The amount of copper added is limited to 0.5 to 2.0% by weight. With less than 0.5% by weight copper does not toughen the base structure, while with more than 2.0% by weight it renders the base structure extremely brittle.

Regarding molybdenum, a part of this element is dissolved in the base structure and forms a solid solution therewith and the balance is dispersed as particles in the base structure. The ferromolybdenum particles are effective for improving wear resistance and strength at high temperatures. However, when the amount of molybdenum is less than 2.5% by weight such effect is not satisfactory, while with more than 6.5% by weight the alloy material becomes brittle so that it cannot be useful any longer. Therefore, the amount of molybdenum to be added is limited to 2.5 to 6.5% by weight.

As stated above, the sintered alloy having excellent properties of the present invention can be obtained with ease by adjusting the content of the various components to the range as described above.

Referring now to the drawings in detail a preferred example of the sintered alloy of the present invention is explained hereinbelow.

Unless otherwise indicated all percent values are by weight in the following example.

EXAMPLE

As a starting material, a powdery composition of 1.2% of graphite powder (passed 325 mesh), 8% of ferromolybdenum powder (passed 150 mesh), i.e., 5% in terms of molybdenum, 3.36% of nickel, 1.36% of copper and the balance iron was mixed with 1% of zinc stearate as a lubricant and the resulting mixture was molded under a pressure of 6 tons/cm$^2$ and sintered at 1,110° C. for 45 minutes in an atmosphere of decomposed ammonia to obtain a valve seat made of the sintered alloy of the present invention. The valve seat had a density of 6.86 g/cm$^3$ and a hardness on the Rockwell B scale of 96 and contained 41.3% by area ratio of pearlite, 21.8% by area ratio of bainite, 27.2% by area ratio of martensite and 9.7% by area ratio of ferromolybdenum particles. On the other hand, a valve seat made of a sintered alloy which comprised 1.2% of carbon, 6.5% of chromium, 2.0% of nickel, 6.0% of cobalt, 2.5% of molybdenum and the balance iron was used as comparison material. The comparison valve seat had a density of 6.5 g/cm$^3$ and a hardness on the Rockwell B scale of 88 and the base structure thereof was pearlite.

The valve seat of the present invention and comparison valve seat were compared and wear of the members was measured using a valve seat wear testing machine under the following conditions.

Number of Rotation: 3,000 rpm
Test Repeating Number: $8\times10^5$
Valve Velocity at the Time of Valve Closing: 0.5 m/sec
Spring Pressure: 35 kg
Number of Valve Rotation: 8–10 rpm
Heating: Combustion of a mixture of propane and air
Test Temperature: 300° C.
Composition of Counterpart Valve: Stellite-covered FIG. 1 shows the results of the wear test and the ordinate indicates the amount of wear of the alloy of the present invention and that of the conventional alloy measured under the same conditions.

As will be clear from FIG. 1, the sintered alloy of the present invention shows a wear amount of $\frac{1}{3}$ times as large as that of the conventional sintered alloy material and proves its superiority.

Figure 2:
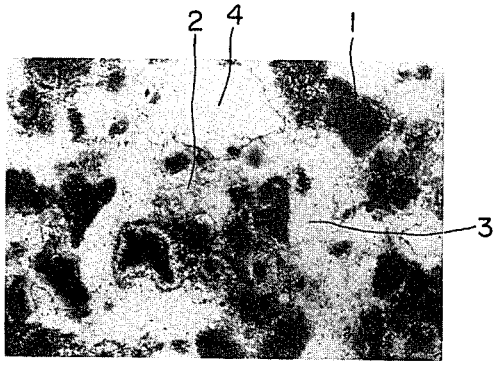
FIG. 2 is a microscopic photograph (200×) of the micro-structure of the sintered alloy of the present invention.

FIG. 2 represents a microscopic observation, shown at 200× magnification of the valve seat made of the sintered alloy of the present invention (erroded). In FIG. 2, the numeral 1 indicates pearlite structure, 2 bainite structure, 3 martensite structure and 4 a ferromolybdenum particle.

While the invention has been described in detail and with reference to specific embodiments thereof, it will be apparent to one skilled in the art that various changes and modifications can be made therein without departing from the spirit and scope thereof.

What is claimed is:

1. A wear resistant ferro-based sintered alloy, consisting essentially of:

a base structure consisting essentially of a mixture of 20 to 50% by area ratio of pearlite, 15 to 50% by area ratio of bainite and 15 to 40% by area ratio of martensite, and 3 to 20% by area ratio of ferromolybdenum particles dispersed uniformly in the base structure, wherein the the alloy consists essentially of 0.8 to 1.5% by weight carbon, 0.5 to 4% by weight nickel, 0.5 to 2% by weight copper, 2.5 to 6.5% by weight molybdenum and the balance iron.

* * * * *